US008992262B2

(12) United States Patent
Pang et al.

(10) Patent No.: US 8,992,262 B2
(45) Date of Patent: Mar. 31, 2015

(54) CROSS TALK REDUCTION FOR A HIGH SPEED ELECTRICAL CONNECTOR

(75) Inventors: Tze Yeong Pang, Singapore (SG); Doron Lapidot, Tokyo (JP)

(73) Assignees: Tyco Electronics Singapore PTE Ltd., Singapore (SG); Tyco Electronics Japan G.K., Kanagawa-ken (JP)

( * ) Notice: Subject to any disclaimer, the term of this patent is extended or adjusted under 35 U.S.C. 154(b) by 83 days.

(21) Appl. No.: 13/492,155

(22) Filed: Jun. 8, 2012

(65) Prior Publication Data

US 2012/0315796 A1 Dec. 13, 2012

(30) Foreign Application Priority Data

Jun. 10, 2011 (SG) ..... 201104274

(51) Int. Cl.

| | |
|---|---|
| ***H01R 24/00*** | (2011.01) |
| ***H01R 13/6471*** | (2011.01) |
| *H01R 24/62* | (2011.01) |
| *H01R 43/16* | (2006.01) |

(52) U.S. Cl.

CPC ..... *H01R 13/6471* (2013.01); *H01R 24/62* (2013.01); *H01R 43/16* (2013.01)

USPC ..... 439/626

(58) Field of Classification Search

CPC .. H01R 13/2442; H01R 13/514; H01R 11/32; H01R 12/57; H01R 23/688; H01R 23/005; H01R 23/6873; H01R 23/7073; H01R 13/65802; G06K 7/0021

USPC ..... 439/108, 607.05, 626

See application file for complete search history.

(56) References Cited

U.S. PATENT DOCUMENTS

| | | | | |
|---|---|---|---|---|
| 6,220,896 | B1 | 4/2001 | Bertoncini et al. | |
| 8,267,721 | B2 * | 9/2012 | Minich | 439/607.05 |
| 8,342,886 | B2 * | 1/2013 | Zhang et al. | 439/660 |
| 8,353,726 | B2 * | 1/2013 | Zhang et al. | 439/629 |
| 8,532,240 | B2 * | 9/2013 | Tracy et al. | 375/350 |
| 8,545,240 | B2 * | 10/2013 | Casher et al. | 439/108 |
| 2005/0226355 | A1 * | 10/2005 | Kibune et al. | 375/348 |
| 2009/0221165 | A1 | 9/2009 | Buck et al. | |
| 2010/0054383 | A1 * | 3/2010 | Mobin et al. | 375/371 |
| 2010/0238993 | A1 * | 9/2010 | Huang et al. | 375/233 |

FOREIGN PATENT DOCUMENTS

| | | | |
|---|---|---|---|
| JP | 2006114245 | A | 4/2006 |
| JP | 2007157594 | A | 6/2007 |
| JP | 2010177037 | A | 8/2010 |
| WO | 2010056935 | A1 | 5/2010 |
| WO | 2010068671 | A1 | 6/2010 |

* cited by examiner

*Primary Examiner* — Abdullah Riyami
*Assistant Examiner* — Vladimir Imas
(74) *Attorney, Agent, or Firm* — Barley Snyder

(57) ABSTRACT

An electrical connector has a housing receiving one or more series of electrical contacts. Each series of electrical contacts has a plurality of ground contacts and a plurality of signal contacts. The signal contacts are positioned in between the ground contacts, and the plurality of ground contacts are integrally connected to each other by a bus bar within the housing.

23 Claims, 10 Drawing Sheets

200

300

CROSS TALK REDUCTION FOR A HIGH SPEED ELECTRICAL CONNECTOR

CROSS-REFERENCE TO RELATED APPLICATIONS

This application claims the benefit of the filing date under 35 U.S.C. §119(a)-(d) of Singapore Patent Application No. 201104274-4, filed Jun. 10, 2011.

FIELD OF THE INVENTION

This invention relates broadly to crosstalk reduction for a high speed electrical connector. In particular, the invention relates to crosstalk reduction for a connector such as 12G SAS (12 Gbps Serial Attached SCSI) connector.

BACKGROUND

Electrical connectors are generally used to provide signal connections between various electronic devices and have electrical contacts for connecting electrical signals as well as ground.

Due to usage of micro-electronic devices, the increase in complexity of design of electric circuits has resulted in the need to use electrical connectors with closely positioned electrical contacts. It is generally known that such close proximity may cause crosstalk between adjacent signal contacts.

Crosstalk is an electrical phenomenon in signal transmission due to electrical signal interference between adjacent signal lines. Crosstalk in signal transmission leads to loss in signal integrity. Crosstalk in high speed electrical connectors can cause insertion of unwanted spikes into signal lines resulting in loss of high frequency signals. Often, resonance occurs when there is a shift in frequency due to crosstalk, which leads to signal degradation.

Conventionally, as shown in FIG. 1, in order to reduce crosstalk, a connector 100 is has adjacent signal contacts 101 separated from ground contacts 103. In other words, signal contacts 101 are located in between ground contacts 103 and separate ground coupling contacts 105 are provided to connect all the ground contacts 103. The electrical connection of separate ground coupling contacts 105 to ground contacts 103 relies on mechanical force of the ground coupling contacts 105, which deteriorates over time.

There is thus a need to provide an electrical connector that seeks to address one or more of the above disadvantages.

SUMMARY

Embodiments of the present invention provide a high speed electrical connector with reduced crosstalk. One example of the high speed electrical connector is a 12G SAS connector.

The invention is embodied in an electrical connector having a housing receiving one or more series of electrical contacts. Each series of electrical contacts has a plurality of ground contacts and a plurality of signal contacts. The signal contacts are positioned in between the ground contacts, and the plurality of ground contacts are integrally connected to each other by a bus bar within the housing.

BRIEF DESCRIPTION OF THE DRAWINGS

The invention is described in more detail below with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1:
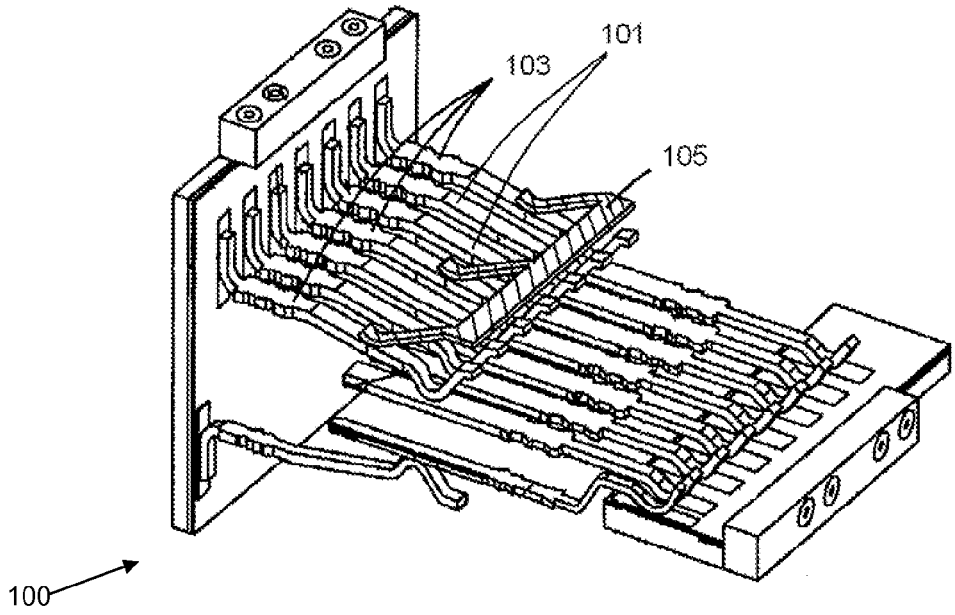
FIGURE 1 PRIOR ART
FIG. 1 is a perspective view of a conventional electrical connector.

Illustrative embodiments of the invention will be described in detail with reference to the attached drawings, wherein the like reference numerals refer to the like elements. The invention may, however, be embodied in many different forms and should not be construed as being limited to the embodiments set forth herein.

Figure 2:
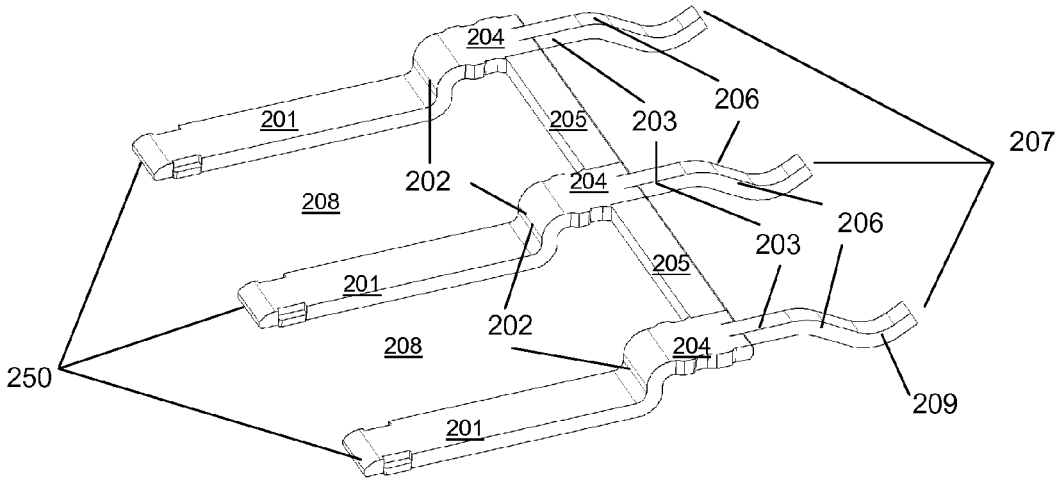
FIG. 2 is a perspective view of a bussed ground contact used in a plug of the electrical connector.

Referring to FIG. 2, an exemplary bussed ground contact 200 used in a plug of the electrical connector is illustrated. Three ground contacts 250 are integrally connected by a bus bar 205.

Figures 4A, 4B:
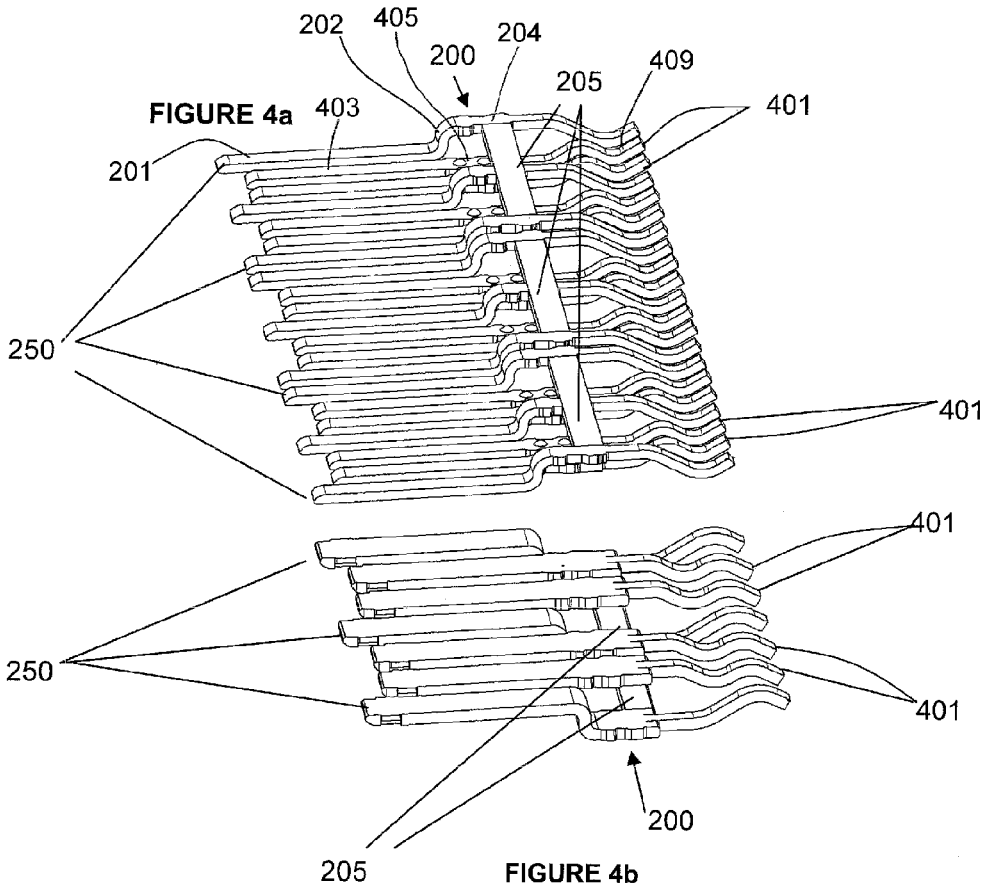
FIG. 4*a* is an exemplary perspective view showing electrical contacts of a 12G SAS connector plug.
FIG. 4*b* is a partial inverted perspective view of FIG. 4*a;*

Each ground contact 250 has a linear contact portion 201 and a terminal portion 207 that are connected by a substantially rectangular base 203. The base 203 has a orthogonal wall 202 and a securing section 204. The terminal portion 207 has an inclined portion 206 and an arcuate portion 209. The orthogonal wall 202 connects the contact portion 201 and one end of the securing section 204, while the inclined portion 206 connects the other end of the securing section 204 and the arcuate portion 209. Substantially at the center, the securing sections 204 are integrally connected by a bus bar 205. As a result, the three ground contacts 250 provide two channels 208 through which signal contacts as shown in FIGS. 4*a* and 4*b* are provided. The bus bars 205 provide ground integrity between the ground contacts 250. In other words, the bus bars 205 provide reduction of ground loop inductance.

Figure 3:
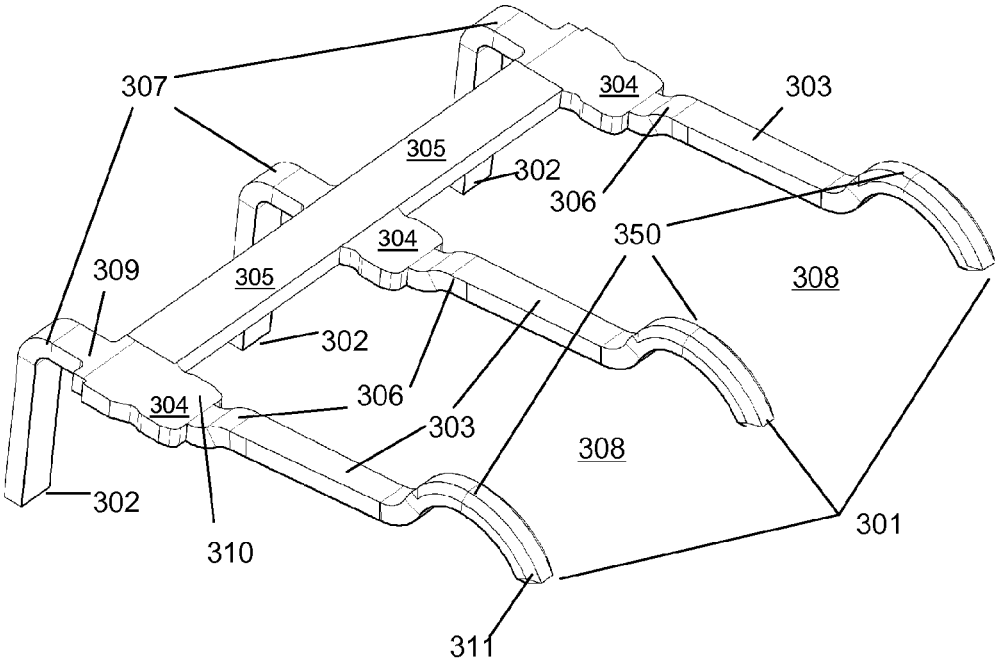
FIG. 3 is a perspective view of a bussed ground contact used in a receptacle of the electrical connector.

Referring to FIG. 3, an exemplary bussed ground contact 300 used in a receptacle of the electrical connector is illustrated. Three ground contacts 350 are integrally connected by a bus bar 305.

Figures 5A, 5B:
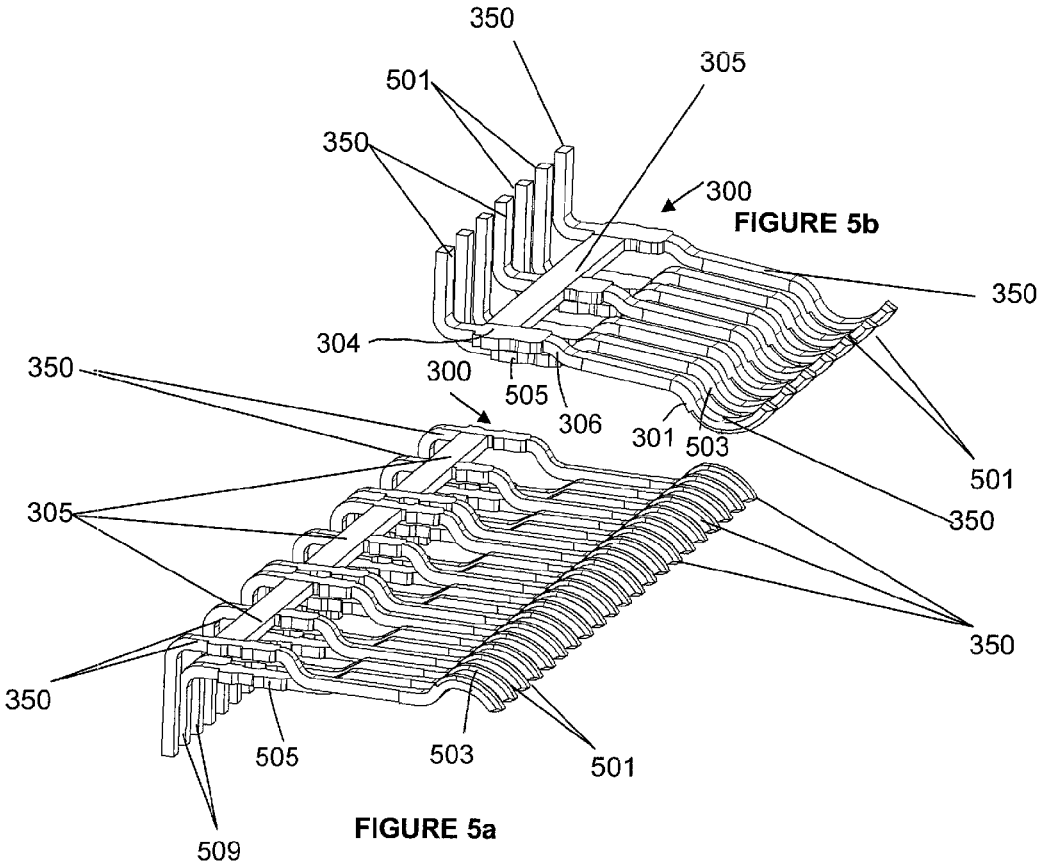
FIG. 5*a* is an exemplary perspective view showing electrical contacts of a 12G SAS connector receptacle.
FIG. 5*b* is an inverted perspective view showing electrical contacts of a 12G SAS connector receptacle with another bussed ground contact connected integrally with bus bars.

Each ground contact 350 has a contact portion 301 and a terminal portion 307 that are connected by a base 310. The terminal portion 307 has a substantially orthogonal wall 302 and an extension 309. The base 310 has of a securing section 304 and an inclined wall 306. One end of the orthogonal walls 302 terminates outside of the receptacle, for mounting on a PCB, while the other end of the orthogonal wall 302 is connected to one end of the extension 309. The other end of the extension 309 is connected to one end of the securing section 304. The inclined wall 306 connects the other end of the securing section 304 and an arm 303, which in turn is connected to an arcuate contact portion 311. Substantially at the center, the securing sections 304 are integrally connected by a bus bar 305. As a result, the three ground contacts 350 provide two channels 308 through which signal contacts as sown in FIGS. 5*a* and 5*b* are received. The integrally connected bus bars 305 provide ground integrity between the ground contacts 350. In other words, the bus bars 305 provide reduction of ground loop inductance.

FIG. 4*a* is an exemplary perspective view showing electrical contacts of a 12G SAS connector plug (without a connector housing) in accordance with an embodiment of the present invention. The illustration shows three sets of the bussed ground contacts 200, with each connected integrally by bus bars 205. A pair of signal contacts 401 is provided between two ground contacts 250, in between the channels 208 as shown in FIG. 2 and beneath the bus bars 205.

The pair of signal contacts 401 is a pair of differential signal contacts suitable for differential signal transmission.

Each signal contact 401 has a contact arm 403 and a terminal portion 409 that are connected by a retaining section 405. The retaining section 405 has barbs on both sides thereof for securing to the connector housing of the connector plug.

The bus bars 205 are located in the connector housing so as to overlap the retaining section 405. The retaining section 405 has a width slightly wider than any other portion of the signal contact 401 which affects a stronger coupling of the signal contacts 401 with the bus bars 205.

The securing section 204 and the bus bar 205 are offset from the retaining section 405 of the signal contact 401 due to the orthogonal wall 202, while the contact portion 201 of the ground contact 250 and the contact arm 403 of the signal contact 401 are positioned in the same plane.

FIG. 4*b* is a partial inverted perspective view of FIG. 4*a*, showing a set of the bussed ground contacts 200 connected integrally with bus bars 205. A pair of signal contacts 401 is shown between the two ground contacts 250. Two pairs of signal contacts 401 are shown in FIG. 4*b*. One pair is a signal transmitting (Tx) pair and the other pair is signal receiving (Rx) pair. The Tx and Rx pairs are separated by the central ground contact 250 to reduce crosstalk between the pairs.

FIG. 5*a* is an exemplary perspective view showing electrical contacts of a 12G SAS connector receptacle (without connector housing) in accordance with an embodiment of the present invention. The illustration shows three sets of the bussed ground contacts 300 each connected integrally with bus bars 305. A pair of signal contacts 501 is provided between two ground contacts 350, in between the channel 308 and beneath the bus bar 305.

The pair of signal contacts 501 is also a pair of differential signal contacts suitable for differential signal transmission.

Each signal contact 501 has a curved contact portion 503 and an L-shaped terminal portion 509. The L-shaped terminal portions 509 are connected by a retaining section 505. The retaining section 505 has barbs on both sides thereof for securing to the connector housing of the connector receptacle.

The bus bars 305 are located in the connector housing so as to overlap the retaining section 505. The retaining section 505 has a width that is slightly wider than any other portion of the signal contact 501 affecting a stronger coupling of the signal contacts 501 with the bus bars 305.

FIG. 5*b* is an inverted perspective view showing electrical contacts of a 12G SAS connector receptacle with another bussed ground contact 300 connected integrally with bus bars 305. A pair of signal contacts 501 is shown between the two ground contacts 350.

Two pairs of signal contacts 501 are shown in FIG. 5*b*. Like the signal contacts 401, one pair is signal transmitting (Tx) pair and the other pair is signal receiving (Rx) pair. The Tx and Rx pairs are separated by the central ground contact 350 to reduce crosstalk between the pairs.

The securing section 304 and the bus bar 305 are positioned offset from the retaining section 505 of the signal contact 501 due to the inclined wall 306, while the contact portion 301 of the ground contact 350 and the contact portion 503 of the signal contact 501 are positioned in the same plane.

Figure 6A:
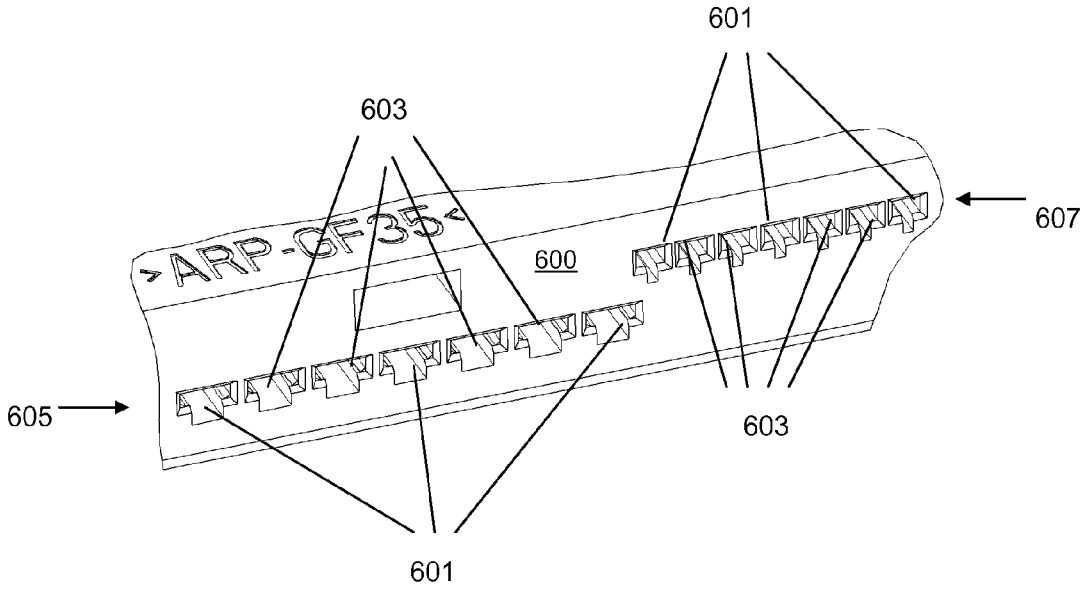
FIGURE 6a PRIOR ART
FIG. 6*a* is a partial perspective view of a housing for a conventional 12G SAS connector plug.

FIG. 6*a* is a partial perspective view of a housing 600 for a conventional 12G SAS connector plug. Along an elongate or lateral direction of the housing 600, the housing 600 has a plurality of series 605, 607 of channels 601, 603. Each series 605, 607 has three channels 601 for receiving the ground contacts (not shown) and four channels 603 for receiving the signal contacts (not shown). The channels 601, 603 are positioned in the direction parallel to the lateral direction of the housing 600. The channels 601 are positioned at ends and the center of each series 605, 607 while a pair of channels 603 are positioned in between the channels 601.

Figure 6B:
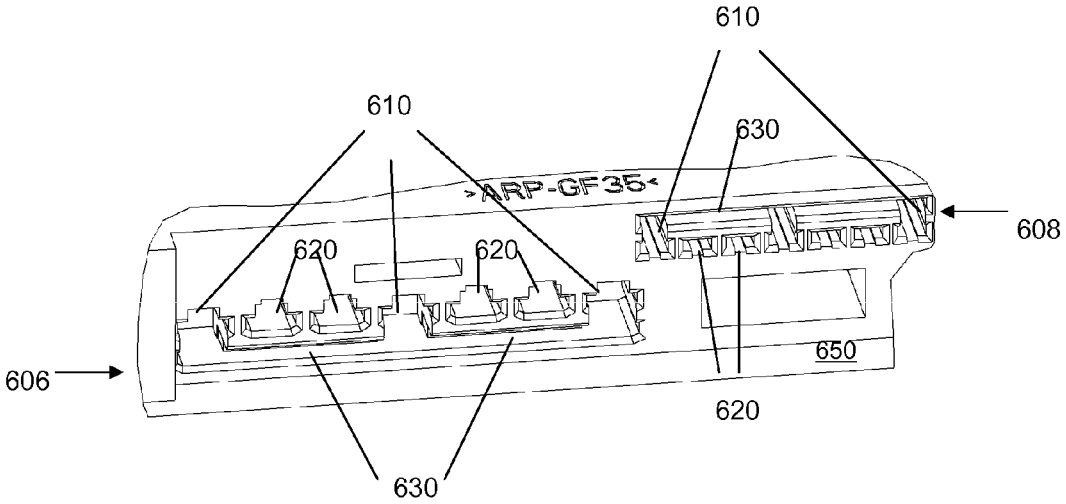
FIG. 6*b* is a partial perspective view of a housing for a 12G SAS connector plug.

FIG. 6*b* is a partial perspective view of a housing for a 12G SAS connector plug in accordance with an embodiment of the invention. Along an elongate or lateral direction of the housing 650, the housing 650 comprises a plurality of series 606, 608 of channels 610, 620. Each series 606, 608 has three channels 610 for receiving the ground contacts 250 as shown in FIG. 2, FIG. 4*a* and FIG. 4*b* and four channels 620 for receiving the signal contacts 401 as shown in FIG. 4*a* and FIG. 4*b*. The channels 610, 620 are positioned in the direction parallel to the lateral direction of the housing 650. The channels 610 are positioned at ends and the center of each series 606, 608, while a pair of channels 620 are positioned in between the channels 610.

Unlike the conventional housing 600, the channels 610 for receiving the ground contacts 250 are joined together by connection channels 630 extending between the two ends of each series 606, 608. The dimensions of the connection channels 630 are appropriately chosen to accommodate the bus bar 205 as shown in FIG. 2.

Figure 7A:
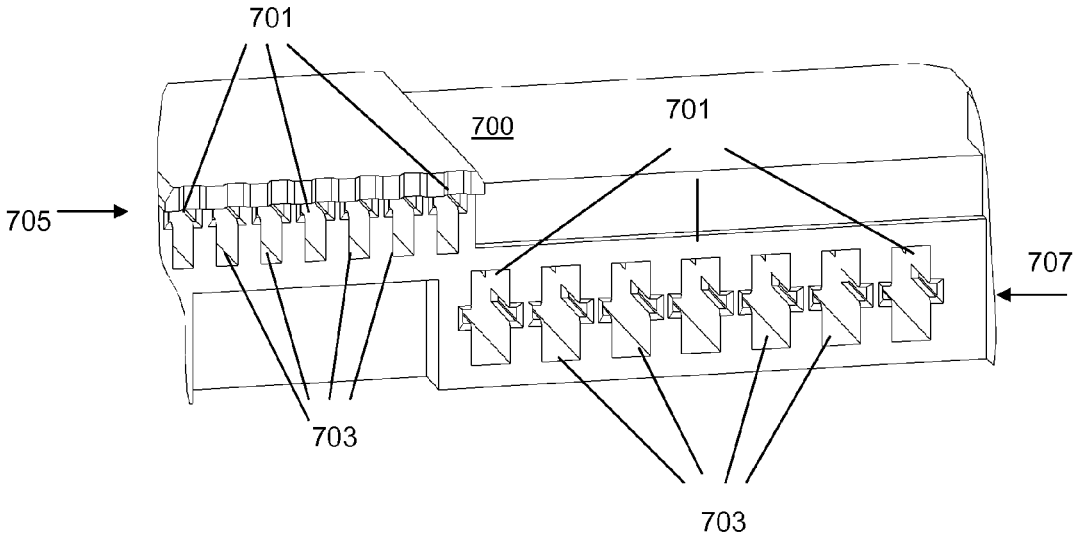
FIGURE 7a (PRIOR ART)
FIG. 7*a* is a partial perspective view of a housing for a conventional 12G SAS connector receptacle.

FIG. 7*a* is a partial perspective view of a housing 700 for a conventional 12G SAS connector receptacle. Along a lateral direction of the housing 700, the housing 700 has a plurality of series 705, 707 of channels 701, 703. Each series 705, 707 has three channels 701 for receiving the ground contacts (not shown) and four channels 703 for receiving the signal contacts (not shown). The channels 701, 703 are positioned in the direction parallel to the lateral direction of the housing 700. The channels 701 are positioned at ends and the center of each series 705, 707, while a pair of channels 703 are positioned in between the channels 701.

Figure 7B:
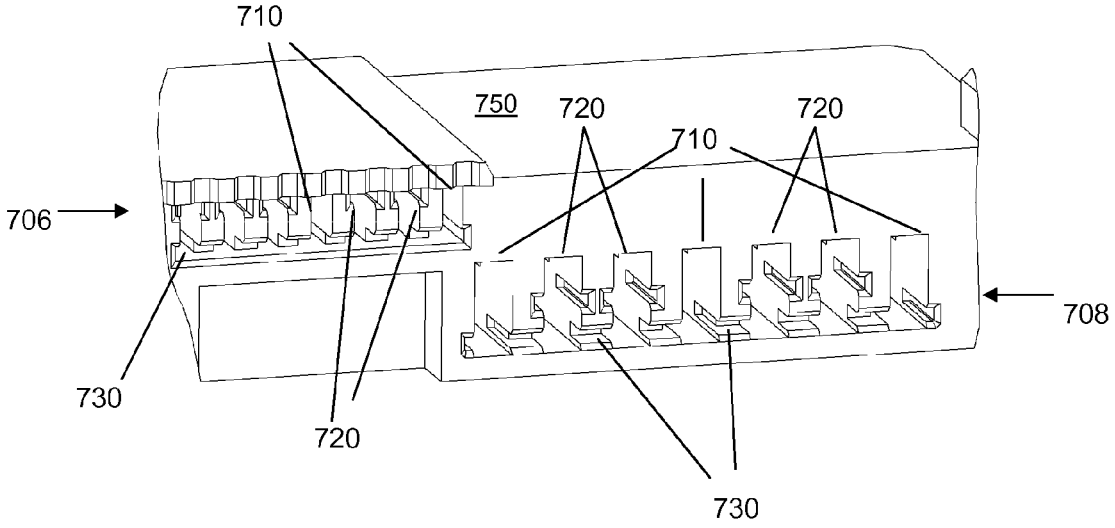
FIG. 7*b* is a partial perspective view of a housing for a 12G SAS connector receptacle.

FIG. 7*b* is a partial perspective view of a housing for a 12G SAS connector receptacle in accordance with an embodiment of the present invention. Along an elongate or lateral direction of the housing 750, the housing 750 has a plurality of series 706, 708 of channels 710, 720. Each series 706, 708 has three channels 710 for receiving the ground contacts 350 as shown in FIGS. 3, 5*a* and 5*b* and four channels 720 for receiving the signal contacts 501 as shown in FIGS. 5*a* and 5*b*. The channels 710, 720 are positioned laterally along the housing 750. The channels 710 are positioned at ends and the center of each series 706, 708, while a pair of channels 720 is positioned in between the channels 710.

Unlike the conventional housing 700, the channels 710 are joined together by connection channels 730 extending between the two ends of each series 706, 708. The dimensions of the connection channels 730 are appropriately chosen to receive the bus bar 305 as shown in FIG. 3.

Figure 8:
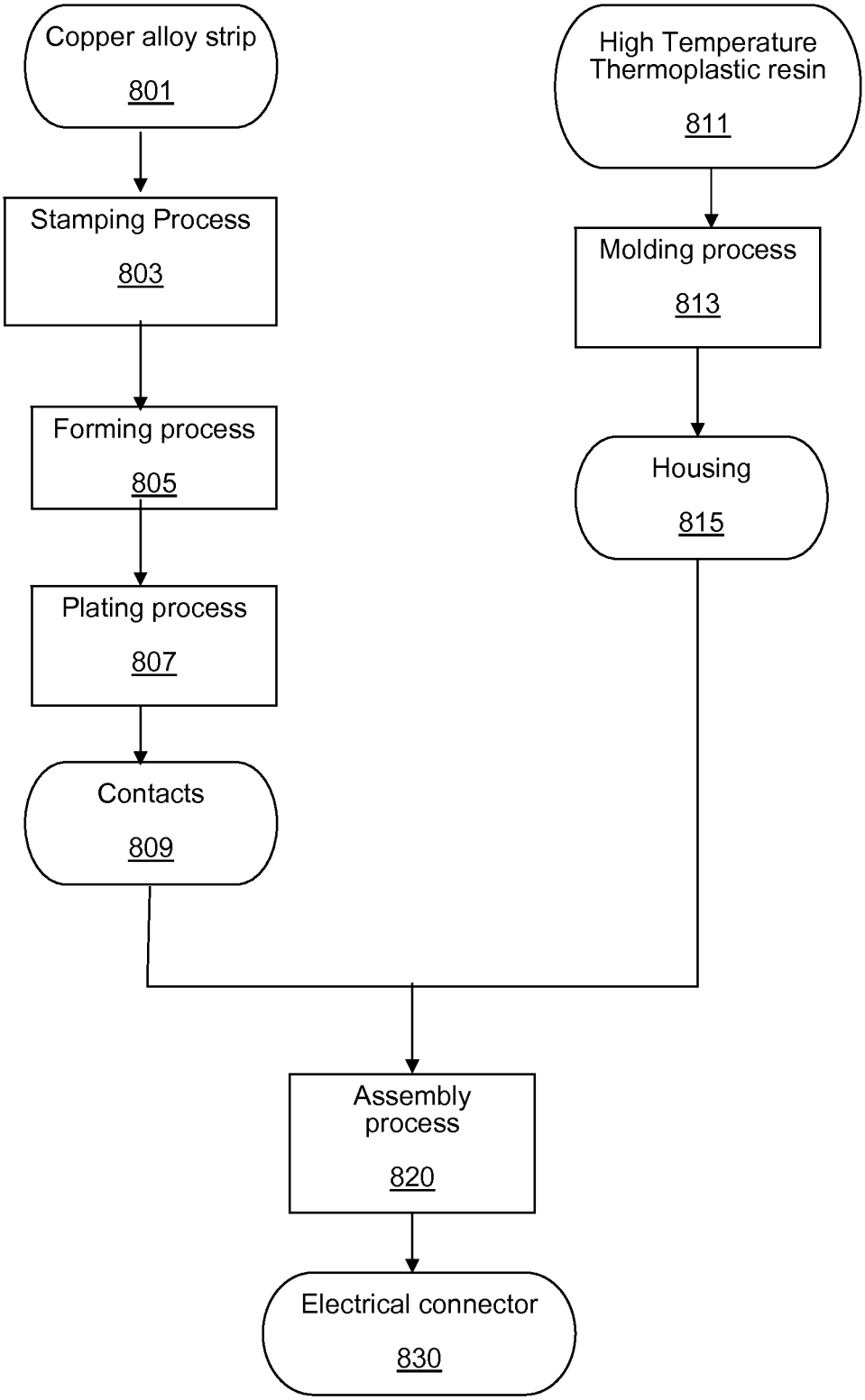
FIG. 8 is a flowchart illustrating a method of fabricating an electrical connector.

FIG. 8 is a flowchart illustrating a method of fabricating an electrical connector according to an exemplary embodiment.

At step 801, a copper alloy strip is provided for fabricating the electrical contacts 250, 350, 401, 501. At step 803, the copper alloy strip stamped to obtain the basic configuration of the electrical contacts 250, 350, 401, 501. At step 805, a forming process is applied to obtain a desired shape required for each of the electrical contacts 250, 350, 401, 501. These contacts 250, 350, 401, 501 are then subjected to a plating process at step 807 to obtain the final configuration of the electrical contacts 250, 350, 401, 501 at step 809.

At step 811, a high temperature thermoplastic resin is provided and in a molding process 813 to fabricate the housing 650, 750 of the electrical connector. At step 820, the electrical contacts 250, 350, 401, 501 obtained at step 809, are assembled into respective channels 610, 620, 710, 720. The respective channels 610, 620, 710, 720 are provided in the housing 650, 750 of the electrical connector to obtain the electrical connector at step 830.

It will be appreciated by a person skilled in the art that numerous variations and/or modifications may be made to the present invention as shown in the specific embodiments without departing from the spirit or scope of the present invention as broadly described. The present embodiments are, therefore, to be considered in all respects to be illustrative and not restrictive.

For example, the securing sections may be integrally connected by the bus bar at any location other than the center thereof.

The plug and receptacle of the electrical connector may include a series of electrical contacts at various pitches, for example, a pitch of 0.8 mm or 1.27 mm.

The electrical contacts 250, 350, 401, 501 of the plug and receptacle of the electrical connector may be fabricated using copper alloy as an example.

The electrical contacts 250, 350, 401, 501 of the plug and receptacle of the electrical connector may be obtained by a stamping process as shown in FIG. 8.

The housing of the plug and receptacle of the electrical connector may be fabricated using a high temperature thermoplastic material by an injection molding process.

Solder feet or pads (not shown) used in the receptacle of the electrical connector may be obtained by using (e.g. a copper alloy) a stamping process.

What is claimed is:

1. An electrical connector comprising:

a housing receiving one or more series of electrical contacts, wherein each series of electrical contacts comprises:

three ground contacts, each having a securing portion extending in a common plane;

a plurality of signal contacts positioned in between each of the three ground contacts; and two electrically connected bus bars extending along an axis in the common plane, positioned between and integrally connecting the three ground contacts positioned on opposite sides of the plurality of signal contacts, and positioned within the housing.

2. The electrical connector according to claim 1, wherein each of the ground contacts comprises a contact portion for establishing contact between mating connectors.

3. The electrical connector according to claim 2, wherein each of the ground contacts comprises a terminal portion.

4. The electrical connector according to claim 3, wherein each of the ground contacts further comprises a base connecting the contact portion and the terminal portion.

5. The electrical connector according to claim 4, wherein the base is substantially rectangular and comprises an orthogonal wall extending in the plane.

6. The electrical connector according to claim 5, wherein the base comprises a securing section, wherein the orthogonal wall connects the contact portion and one end of the securing section, and wherein the securing sections are integrally connected by the bus bar.

7. The electrical connector according to claim 5, wherein the signal contacts are located in between two ground contacts and beneath the bus bar.

8. The electrical connector according to claim 5, wherein each housing of the mating connectors is provided with a connection channel for receiving the two bus bars of the ground contacts.

9. The electrical connector according to claim 1, wherein each of the signal contacts comprises a contact portion for establishing contact between mating connectors.

10. The electrical connector according to claim 9, wherein each of the signal contacts comprises a terminal portion.

11. The electrical connector according to claim 10, wherein each of the signal contacts comprises a retaining section connecting the contact portion and the terminal portion, wherein the retaining section has a width wider than the contact portion and the terminal portion, and wherein the bus bar is located so as to overlap the retaining section of the signal contact.

12. The electrical connector according to claim 1, wherein the number of the signal contacts in between two ground contacts that are integrally connected is two.

13. The electrical connector according to claim 1, wherein the electrical connector is a 12G SAS connector.

14. A method of fabricating an electrical connector comprising the steps of:

providing a housing for receiving one or more series of electrical contacts;

providing three ground contacts, each having a securing section extending in a common plane, and a plurality of signal contacts;

positioning the plurality of signal contacts in between each of the three ground contacts; and positioning two electrically connected bus bars along an axis in the common plane within the housing and an integrally connecting the three ground contacts positioned on opposite sides of the plurality of signal contacts.

15. The method of fabricating an electrical connector according to claim 14, wherein a copper alloy strip is provided for fabricating the electrical contacts.

16. The method of fabricating an electrical connector according to claim 15, wherein the method further comprises a stamping process to obtain a basic of the electrical contacts.

17. The method of fabricating an electrical connector according to claim 16, wherein the method further comprises a forming process obtain a desired shape of each of electrical contacts.

18. The method of fabricating an electrical connector according to claim 17, wherein the method further comprises a plating process to obtain the final configuration of the electrical contacts.

19. The method of fabricating an electrical connector according to claim 14, wherein a high temperature thermoplastic resin is provided and in a molding process to fabricate the housing.

20. The method of fabricating an electrical connector according to claim 14, wherein the housing further comprises receptive channels.

21. The method of fabricating an electrical connector according to claim 20, wherein the electrical contacts are assembled into the respective channels.

22. The electrical connector according to claim 21, wherein each of the plurality of signal contacts includes a retaining section disposed along a plane offset from the common plane of the three ground contacts.

23. The electrical connector according to claim 22, wherein each of the plurality of signal contacts includes a retaining section disposed along a plane offset from the common plane of the three ground contacts.

* * * * *